United States Patent [19]

Laube et al.

[11] 4,186,483

[45] Feb. 5, 1980

[54] POTENTIOMETER CONTACT AND ROTOR ASSEMBLY

[75] Inventors: David E. Laube, Banning, Calif.; Loran R. Simpson, Ames, Iowa

[73] Assignee: Bourns, Inc., Riverside, Calif.

[21] Appl. No.: 873,306

[22] Filed: Jan. 30, 1978

[51] Int. Cl.[2] ..... H01R 9/00

[52] U.S. Cl. ..... 29/630 B; 338/171; 338/202

[58] Field of Search ..... 338/171, 160, 202, 162, 338/334; 29/610

[56] References Cited

U.S. PATENT DOCUMENTS

| | | | |
|---|---|---|---|
| 2,760,036 | 8/1956 | Raymer | 338/171 X |
| 3,328,707 | 6/1967 | Louis et al. | 338/168 X |
| 3,579,822 | 5/1971 | Dieterich | 29/630 R |
| 3,704,436 | 11/1972 | Froebe et al. | 338/202 |
| 3,733,573 | 5/1973 | Dieterich | 338/202 |
| 3,755,892 | 9/1973 | Dieterich | 29/630 R |
| 3,766,646 | 10/1973 | Froebe et al. | 29/630 B |
| 3,982,221 | 9/1976 | Smith | 338/202 |

*Primary Examiner*—C. L. Albritton

*Attorney, Agent, or Firm*—Paul H. Ware; William G. Becker

[57] ABSTRACT

A total assembly system combining the fabrication of multiwire contact springs into a wiper contact with the assembly of the wiper contact so fabricated into a potentiometer rotor blank. A radius-truncated cone projection acts as a reducer of the heat power required to make a multiwire weld. By allowing the radius truncated cone projection to be pressed into the wires to achieve the weld, the interference nubs, heat staking, epoxy and ultrasonic staking operations required in the prior art are eliminated. The wiper contact is itself assembled to and retained by the rotor blank in an integrated process by means of a mechanical interference fit.

2 Claims, 7 Drawing Figures

I
II
III
IV
V
VI
VII
VIII
2.
7.
12
16
18
20
22
24
26
28
30
32
34
38
40
42
44
46

POTENTIOMETER CONTACT AND ROTOR ASSEMBLY

BACKGROUND OF THE INVENTION

1. Field of the Invention

This invention relates generally to variable resistors and potentiometers and more particularly to the fabrication of contact wipers and the assembly thereof into rotor blanks of these variable resistors and potentiometers.

2. Description of the Prior Art

Variable resistors or potentiometers are known in the prior art in which the parts are held together by rivets and/or bolts. In some of these earlier devices the heat, necessarily generated by welding, destroyed the temper of the wiper spring material thus rendering it useless and the potentiometers thus manufactured inoperative. In many cases, undesirable noise resulted from the imperfect engagement between the sliding wiper contact and the resistance element. Elimination of these problems made the potentiometer design complicated and accordingly prohibitively expensive. Some of the wiping brushes of the prior art were formed by hand, as is related in U.S. Pat. No. 2,760,036 to R. C. Raymer at column 8, starting at line 58. In this fabrication a dull razor blade was actually employed to "press the short end of the blank into the groove 136, thereby forming a V-shaped contact portion 138". Obviously, if the razor blade were not dull enough, so that the material was cut through, the operation would have to be repeated with a suitably blunt razor blade. In this prior art assembly, it was also necessary to employ a "suitable conducting cement" and "a heat resisting paint or laquer". In further complication, it was necessary to use very expensive contact materials as the inventor reports at column 13, starting at line 42: "In practice, the brush is composed of a soft noble metal or a noble metal alloy. Among the metals found suitable for use in the wiper brush are platinum, paladium, nickel, gold and soft alloys thereof." It is of interest to note that a total of more than 40 tedious steps are required in the fabrication of the wiper brush and its assembly into the rotor blank in the described device. In U.S. Pat. No. 3,010,090 to Vacha, there are mentioned at least some of the effects of soldering in the assembly of these instruments. He finds that too much solder increases the mass at the end of the contact thus resulting in variations in contact resistance under certain vibratory conditions and, by contrast, too little solder leads to joint failure due to fatique. Herein it is also noted that "the application of heat to weld or solder the parts affects the temper of the spring adversely."

As is made increasingly evident by an examination of the prior art, it has been necessary to perform a large number of operations, some of which must be performed by hand, with the attendant rejection of many parts, thus, exorbitant assembly expense has been involved. It is also made evident by such examination that the potentiometer manufacturing art suffered from much uncertainty and much waste through the fabrication of many unusable units and a great number of faulty parts.

Attention is invited to the following listed prior art patents for an indication of the order of difficulty encountered in the manufacture of these instruments in the immediate past.

| U.S. Pat. No. | Title | Inventor |
|---|---|---|
| 1,399,492 | Double Switch Blade | H. Krantz |
| 2,291,246 | Volume Control | J. Marsten |
| 2,760,036 | Metallic Film Potentiometer | R. C. Raymer |
| 2,956,253 | Potentiometer | J. Clayton, Jr. et al |
| 3,010,090 | Slider Contact | F. P. Vacha |
| 3,119,088 | Wiper Assembly for a Multiturn Potentiometer | M. J. Fliegler et al |
| 3,274,368 | Laminated Distributor Brush | J. L. DeBoo et al |
| 3,328,707 | Wiper Assembly for Potentiometers | A. S. Louis et al |
| 3,704,436 | Multiware Potentiometer Contact Device | R. L. Froebe et al |

A novelty search conducted in the U.S. Patent and Trademark Office for the purpose of locating any patents relevant to the subject matter of the present invention resulted in the discovery of U.S. Pat. No. 3,733,695, Method of Making Potentiometer Terminations, by S. W. Frey, Jr. et al. The field of this search included:
Class 29—Metal Working
Subclasses 621 and 630

It would, therefore, as indicated by research into the subject, be a great advantage to the art to provide an improved wiper contact spring and method of assembly.

It would be a further advantage to provide such an improved wiper contact spring at a greatly reduced unit cost.

Another advantage would be the reduction of the number and complexity of the steps required presently in the fabrication of a potentiometer contact and rotor.

An additional advantage would be the provision of a combination of the manufacture of multiwire contact springs with the assembly of the contact spring into a rotor so that both manufacture and assembly become one integrated process.

It would, of course, be a desirable advantage to provide the above advantages in an economical process.

SUMMARY OF THE INVENTION

It is an object of the present invention to provide an improved wiper contact spring and method of assembly.

A further object of the present invention is to provide such improved wiper contact spring at a greatly reduced unit cost.

Another object of the invention is to greatly reduce the number and complexity of the steps required in the fabrication of a potentiometer contact and rotor.

A still further object of the present invention is to combine the manufacture of a multiwire contact spring with its assembly into a rotor such that fabrication and assembly become one integrated process.

In the accomplishment of these and other objects, a potentiometer contact and rotor assembly device is provided in which multiwire contact springs are fabricated and assembled into potentiometer-rotors in one integrated process. In preparing a wiper support plate to carry the wiper contact, a ridge is formed thereon. In the preparation of this ridge, an enlarged cross-section would appear as an arcuate surface having a slot underneath of trapezoidal configuration. Because of this appearance, it will be convenient to refer to this formation as a radius-truncated cone projection. This radius-truncated cone projection forms the contact surface for the welding thereto of a multiwire contact strip. The wiper support plate itself is formed from a support strip which is an elongated strip of sheet metal. Somewhat L-shaped members are formed by stamping, as is well known in the art, and a series of progression-locator holes is formed in the support strip so as to realize a one-to-one relationship with said somewhat L-shaped members. It is then possible to define the positions of the L-shaped members in terms of their associated progression-locator holes. The longer part of the L-shaped strip shall be referred to as a tab strip in what follows and one of its functions is to have a radius-truncated cone projection formed lengthwise thereupon for subsequent use in a welding operation. Another radius-truncated cone projection is formed parallel to the prior one but upon the short part of the L-shaped member, also for subsequent use in a welding operation. The function of the radius-truncated cone projections is to reduce welding contact areas, thereby reducing the power required and the heat developed, and, therefore, they are stamped into the support strip by means of a primary die. A multiwire contact strip is placed in contact with the radius-truncated cone projections and welded, in one embodiment, by means of capacitive discharge as is known in the art. There are thus two complete weld areas, one for the purpose of securing the multiwire contact to-be-formed to the tab strip and another for holding the members of the multiwire contact together upon shearing. A contact row is formed at the unattached end of the multiwire contact, i.e., the wiper blank, which will perform the actual wiping function on the resistive element of the potentiometer. A bend is then formed in the multiwire contact so as to form a wiper contact spring for positive contact with the resistive element. It remains now to complete the formation of the wiper contact by separating it from the support strip. In performing this operation, the wiper contact is severed from the support strip by a cutoff shear so as to leave projecting interference tabs, and at the same time, the wiper contact, being positioned by means of its progression-locator holes, is held by a vacuum operated inserter. The vacuum operated inserter positions the wiper contact so as to force it into a rotor slot that has been formed in a rotor blank and thus forces the interference tabs upward so as to give a mechanical interference fit that performs the function of locking the wiper contact into the rotor slot. Thus a wiper contact has been fabricated and assembled into a rotor in one integrated process in a positive, conveniently repeatable, economical manner that easily lends itself to mass production methods.

Other objects and advantages of the present invention are set out or made evident in the following detailed description of the invention and the appended claims.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings wherein like reference characters refer to like parts throughout and in which:

FIG. 1*a* is a perspective drawing of a completed wiper contact having a part of the contact row and wiper spring cut away so as to show two inteference tabs in special prominence.

DETAILED DESCRIPTION

Figures 1, 2, 3, 4, 5, 6, 7:
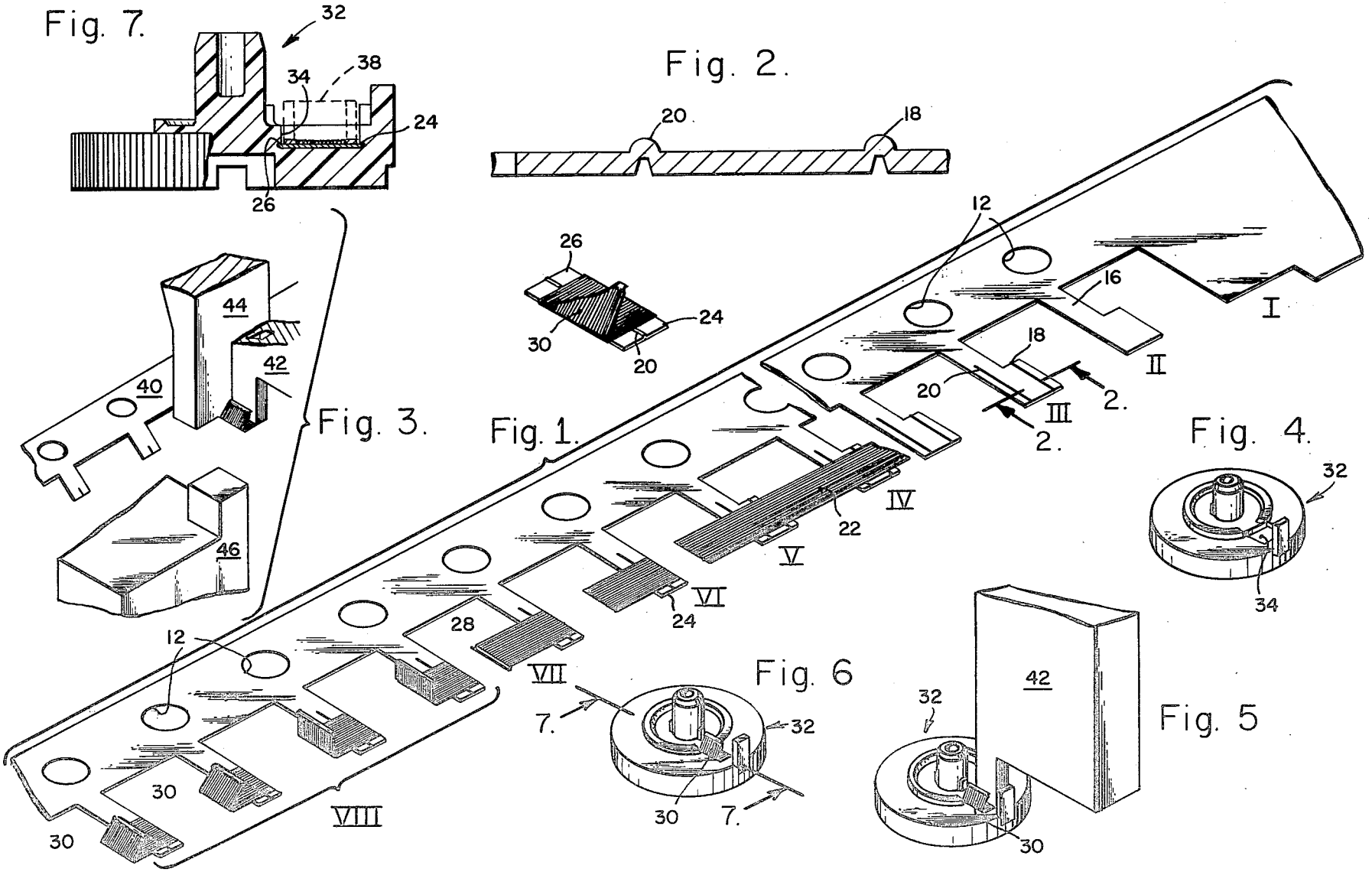
FIG. 1 illustrates in perspective the formation of a plurality of wiper contacts from a metal support strip and a multiwire contact strip and includes fabrication stations I through VIII.
FIG. 2 is an enlarged detail cross-section taken along the sight lines 2—2 of FIG. 1 and showing the radius-truncated cone projections in detail.
FIG. 3 illustrates a shearing operation showing a residue strip and the wiper contact retained by the vacuum operated inserter.
FIG. 4 shows a rotor blank having a rotor slot, prior to insertion of the wiper contact.
FIG. 5 shows the wiper contact being inserted into the rotor slot to complete assembly of the rotor and wiper contact.
FIG. 6 shows the completed rotor-wiper contact assembly.
FIG. 7 is an enlarged partial view taken along the sight lines 7—7 of FIG. 6 so as to show interference fit of tabs with the sides of the rotor slot.

Although specific embodiment of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring now to FIG. 1 with greater particularity, at station I a sheet metal support strip 10 is shown prior to any operations being performed upon it. The strip is first trimmed before moving to station II. At station II, the progression-locator holes 12 are formed and also the L-shaped member having long shank 16, referred to hereafter as a tab strip, and short shank 14, referred to hereafter as a wiper support plate. It will be apparent from the figure that progression-locator holes 12 form a one-to-one relationship with the L-shaped members. At station III first and second radius-truncated cone projections, 18 and 20 respectively, are formed into the L-shaped members, preparatory to a welding operation to be performed at station IV. At station IV a multiwire contact strip 22 is positioned in contact with radius-truncated cone projections 18 and 20 and welded thereto. The prior art patent to Froebe et al, U.S. Pat. No. 3,704,436, for Multiwire Potentiometer Contact Device, describes a method by which a large number of wires of fine gauge are easily fabricated into a group of independently flexing contact fingers comprising, for example, from six to thirty or more wires in side-by-side arrangement. Froebe in particular gives an example in which in one present commercially produced form, nineteen fingers are utilized in a device whose brush width is only 3/32 inches wide at the contact line. The methods of that invention, being commonly owned by the assignee of the instant invention, are utilized in this fabrication/assembly. At station V a shearing operation severs the multiwire contact strip 22 at the wiper support plate 14 so as to form wiper blank 36 from the multiwire contact strip 22. At station VI, the short shank of the L-shaped member, wiper support plate 14, is severed from tab strip 16 preparatory to forming a contact row 28 in the wiper blank 36. It will be noted that multiwire contact strip 22 has been secured to the L-shaped member so as to leave a projecting interference tab 24. Contact row 28 is then formed at station VII by conventional means well known in the art. A progressive bending operation, shown in four steps, is performed at station VIII so as to form wiper contact spring 30.

At FIG. 1*a*, the completed wiper contact, with a part of the wiper spring and the contact row cut away, is shown. It will be realized, of course, by reference to the drawings, that the completed wiper contact remains attached to support strip 10 and as indexed by progression-locator holes 12 until its assembly into rotor slot 34 (FIG. 4) of rotor blank 32. The second radius-truncated cone 20, welded to the multiwire contact, remains with the completed wiper contact providing positive mechanical security. Of primary interest in FIG. 1*a* are the interference tabs identified by numerals 24 and 26. Upon insertion into a rotor slot 34 (FIG. 4) these interference tabs become bent up thus locking the wiper into the rotor slot by the mechanical interference formed thereby.

Referring now to FIG. 2, an idealized, enlarged detail cross-sectional view taken along sight lines 2—2 of FIG. 1 may be examined. In cross-section, the projections 18 and 20 used in welding the multiwire contact strip to the tab strip and wiper support plate, appear as semicircular promontories with a frustum of a cone beneath, hence the term radius-truncated cone projection used to describe these ridges formed in the wiper support plate and tab strip. It will be remembered that the function of the radius-truncated cone projections is to reduce welding contact areas, thereby reducing the power required and the heat developed.

The perspective of FIG. 3 is intended to illustrate part of the simultaneous severing of the contact wiper 38 from the residue strip 40 by means of the cutoff shear 44 and its associated lower shear support 46, and the insertion of contact wiper 38 into rotor slot 34 of rotor blank 32. Positional integrity is maintained in this operation by means of the associated progression-locator holes 12 and the vacuum operated inserter 42.

Attention is now invited to FIG. 4 where a rotor blank 32 is shown with a rotor slot 34. This rotor slot is the receiving element into which the wiper contact 38 will be forced in such a way as to create a mechanical interference with interference tabs 24 and 26, thus retaining the wiper contact 38 in the rotor slot 34.

FIGS. 5 and 6 are intended to illustrate another part of the simultaneous severing of the contact wiper 38 from the residue strip 40 and the insertion of the wiper into the rotor blank 32 by means of the vacuum operated inserter 42, and the completed rotor assembly, respectively. In both figures, the establishment of the location of the wiper spring 30 by means of the progression-locator holes 12 defines the orientation of the interference tabs 24 and 26 even though they are not visible in the drawings.

FIG. 7, taken along sight lines 7—7 of FIG. 6 and much enlarged, shows how wiper contact 38, after having its tabs 24 and 26 forced into rotor slot 34, is retained in rotor blank 32 by the mechanical interference created by bending up of the interference tabs 24 and 26 by the side walls of rotor slot 34.

Thus there has been described a potentiometer contact and rotor assembly device that makes possible the manufacture of a contact wiper and its subsequent installation into a potentiometer rotor by means of one integrated process. Great improvements in ease of manufacture, mechanical integrity, repeatability, reliability and economy have been provided through the novel advantage of the invention.

It is here pointed out that although the present invention has been shown and described with reference to particular embodiment, nevertheless various changes and modifications obvious to one skilled in the art to which the invention pertains are deemed to lie within the purview of the invention.

What is claimed and desired to be secured by Letters Patent of the United States is:

1. A method of fabricating a potentiometer contact wiper and rotor assembly comprising the steps of:

forming progression-locator holes in a support strip;

forming wiper support plates in a portion of said support strip in one-to-one relationship to said progression-locator holes;

forming tab strips in another portion of said support strip;

defining first projecting interference tabs in relation to said tab strips;

forming at least one radius-truncated cone projection in each of said wiper support plates;

forming at least one radius-truncated cone projection in each of said tab strips;

welding a multiwire contact strip to said wiper support plates and said tab strips at said radius-truncated cone projections;

cutting said multiwire contact strip at said wiper support plates;

shearing said wiper support plates from said tab strips so as to leave a projecting strip of said multiwire contact strip to form wiper blanks;

forming a contact row in said projecting strip of each of said wiper blanks;

forming a wiper contact spring in said potentiometer contact wiper by progressive bending of said projecting a strip into an acute angle in each of said wiper blanks;

locating said potentiometer contact wiper by means of said progression-locator holes;

shearing said contact wiper from said support strip so as to form second projecting interference tabs;

inserting said potentiometer contact wiper into a rotor blank having a slot;

retaining said potentiometer contact wiper in said rotor blank by forcing said potentiometer contact wiper into said slot in said rotor blank so as to bend up said first and second projecting interference tabs causing an interference fit between said projecting interference tabs and said slot in said rotor blank.

2. The method of claim 1 of fabricating a potentiometer contact wiper and rotor assembly wherein forming at least one radius-truncated cone projection in each of said wiper support plates includes stamping so as to form a cross-sectional arcuate upper surface having a lower surface of trapezoidal configuration.

* * * * *